US006428853B1

(12) United States Patent
Eriksson

(10) Patent No.: US 6,428,853 B1
(45) Date of Patent: Aug. 6, 2002

(54) COATING DEVICE AND PROCESS FOR COATING

(75) Inventor: Tore Eriksson, Klässbol (SE)

(73) Assignee: BTG Källe Inventing AB, Säffle (SE)

( * ) Notice: Subject to any disclaimer, the term of this patent is extended or adjusted under 35 U.S.C. 154(b) by 0 days.

(21) Appl. No.: 09/557,970

(22) Filed: Apr. 25, 2000

Related U.S. Application Data

(63) Continuation of application No. 08/836,724, filed as application No. PCT/SE95/01458 on Dec. 5, 1995, now abandoned.

(30) Foreign Application Priority Data

Dec. 22, 1994 (SE) ..... 9404482

(51) Int. Cl.[7] ..... B05D 3/12

(52) U.S. Cl. ..... 427/359; 118/414; 118/123; 118/304

(58) Field of Search ..... 118/410, 117, 118/411, 118, 413, 119, 414, 123, 264, 122, 206, 116, 304, 325; 427/369, 361, 356, 421, 439, 440, 434.2, 365, 359, 428

(56) References Cited

U.S. PATENT DOCUMENTS 2,252,345 A * 8/1941 Johnson
2,333,629 A * 11/1943 Beadle, Sr.
2,653,566 A * 9/1953 Worden
4,869,533 A * 9/1989 Sollinger et al.
5,048,453 A * 9/1991 Eriksson
5,681,618 A * 10/1997 Danrau et al. ..... 118/413
6,093,248 A * 7/2000 Kohl et al. ..... 118/414

OTHER PUBLICATIONS

The Dictionary of Paper, Second Edition, (1951) p. 253.*

* cited by examiner

*Primary Examiner*—Brenda A. Lamb
(74) *Attorney, Agent, or Firm*—Burns, Doane, Swecker & Mathis, LLP

(57) ABSTRACT

Application apparatus for the coating of a travelling web (5), comprising a support roll (3) and a predosage roll (7'), said rolls forming a nip between themselves through which the web is brought to travel, further comprising an application device (21) by which sizing agent or coating agent (13) can be transferred onto the web, and means (19) for final evening of material applied onto the web, characterized in that the application device (21) is designed in such a manner that it transfers directly onto the travelling web (5) said material (13) in a certain excess before entering the nip where predosage is provided before the subsequent and final evening of applied material.

20 Claims, 4 Drawing Sheets

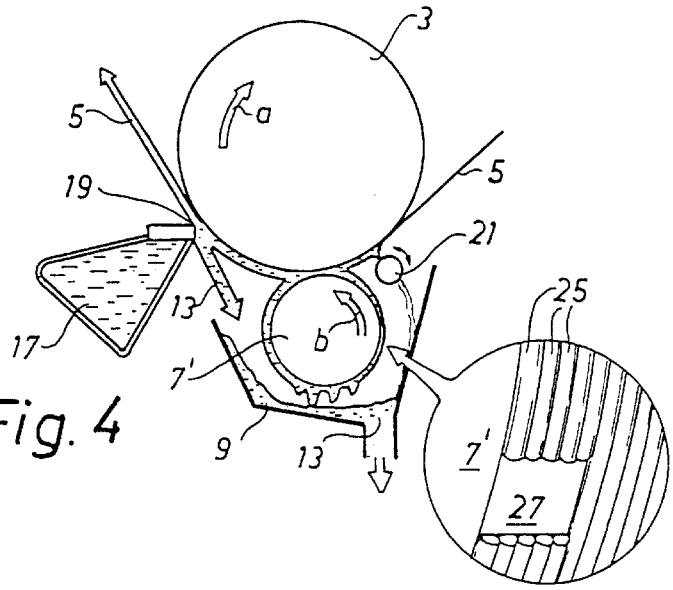
Fig. 4
Fig. 4A
Fig. 5
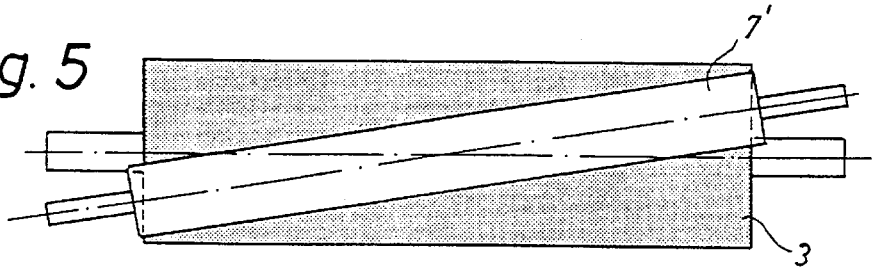
Fig. 6A
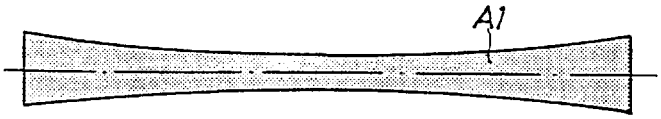
Fig. 6B
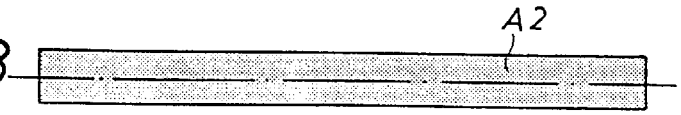
Fig. 6C
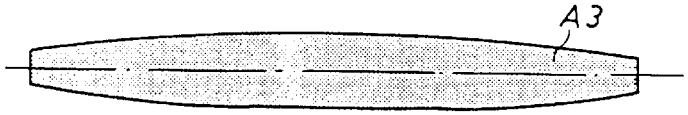

COATING DEVICE AND PROCESS FOR COATING

This application is a continuation, of application Ser. No. 08/836,724, filed May 22, 1997 now abandoned, which is a 371 PCT/SE95/01458 filed Dec. 5, 1995.

The present invention relates to a coating apparatus to apply to a travelling web, particularly a paper web, size or coating agent, as wellas a process for such coating of a travelling web.

The problems with traditional methods for the coating of travelling webs, for example the coating of paper webs, are associated with requirements for increasing web speeds. Such high web speeds result in problems when for example a paper web is fed into a nip between a support roll and a dosage roll and the coating composition shall be transferred from the dosage roll to the paper web in said nip. When the paper web at speeds which can reach 2000 m/min is fed into the nip an air film accompanies the pader web. This air film forms a barrier preventing the liquid transferred by the dosage roll to come into contact with the web in a uniform manner. The presence of this air film furthermore results in problems in that the coating agent is mixed with air thereby forming an unhomogeneous film, certain sections of the web not being covered with coating agent. The downstream evening member, for example a blade, can then not always even out the coating agent so as to cover said sections but uncoated sections remain even after the evening member. Such coating defects are called "skips" in the parer industry and result in uneven coating.

In order to reduce the problems to a reasonable level it is required that the rotational speed of the application roller and the nip between the opposite rolls have the correct magnitude. It is found in practice that the peripheral speed of the dosage roll is of the order of 150 m/min and that the distance between the dosage roll and the support roll is within the range about 0.5 to 0.1 mm. Under these conditions coating can be obtained without skips arising in the coating. However, the adjustment of speed and play in the nip result in substantial problems in connection with practical operation. The sensitivity of the system means that the possibility of controlling the metered amount of coating agent by controlling the distance between the rolls is lost.

Practical experience shows that the quantity of coating agent which must be metered for resulting in an even coating is constituted by a very large excess, of the order of 15 to 30 times the quantity finally deposited on the web. This means that large amounts of coating agent have to be pumped and recirculated which results in cost and space problems in the pumping and sifting of the coating agent.

It should be noted that the present invention is not restricted to solely the coating of paper webs but can be used for the coating of other materials, for example for sizing on travelling paper webs, but the invention will in this disclosure be illustrated mainly in connection with the coating of paper webs.

In summary, it is thus noted that today's techniques for sizing or coating of travelling webs is associated with the following problems.

- The formation of an air barrier adjacent to the web results in the generation of so called skips.
- Substantial admixture of air in the coating agent takes place in connection with the dosage nip.
- There is restricted possibility to control the metered quantity.
- This means that a large excess has to be metered which in turn results in the following disadvantages.

- Large return flows from the evening member result in significant admixture of air and splatter.
- Parts of the metered film leaves the support roll (by centrifugal force) and results in further splatter and admixture of air.
- High impulse forces are generated on the member, for example a coating blade, which provides for final evening.
- The demand of a large excess of coating agent results in requirements for pumps and sifts of high capacity.

Accordingly, the main object of the present invention is to provide an application apparatus for the coating of a travelling web, which apparatus enables more freedom in the control of the metered quantity of material while providing for an even coating.

Another object of the invention is to provide an application apparatus whereby the admixture of air in the material applied is reduced to a minimum.

Yet another object of the invention is to provide an application apparatus enabling substantial reduction of the excess of metered quantity of sizing agent or coating agent.

A further object of the invention is to provide a process for the application of sizing agent or coating agent on a travelling web while obtaining even coating and avoidance of the generation of so called skips.

For these and other objects which will be clear from the following disclosure there is provided an application apparatus for the coating of a travelling web comprising a support roll and a predosage roll, said rolls forming a nip between themselves through which the web is brought to travel. The application apparatus further comprises an application device by which sizing agent or coating agent can be transferred onto the web. The application device also includes means for final evening or levelling of material applied onto the web.

In accordance with the invention this application device is designed in such a manner that it transfers directly onto the travelling web said material in a certain excess before entering the nip where predosage is provided before the subsequent and final evening of applied material. By this arrangement the travelling web provides for feeding of the applied material up to the nip between the support roll and the predosage roll, the latter having a relatively low rotational speed in the same direction on the paper web. This rotational speed for the predosage roll is not critical in the same manner as in the prior art in view of the fact that the roll in question no longer has for its function to transport said material up to the nip. In view of the fact that the air film on the travelling web is broken in view of the design of the application apparatus a homogeneous wedge of material is now formed in the entrance to the nip between the counter roll and the dosage roll, and the excess from this wedge flows along the peripheri of the predosage roll down into some suitable collection means further described below. In this manner the distance between the two rolls can now be used as an instrument for the control of the flow of applied material up to the member for the final evening.

According to a preferred embodiment of the apparatus according to the invention said application means can comprise a tube extending across substantially the whole width of the web and which is provided with a slit extending along the tube or apertures or nozzles distributed along the tube. Through this slit or through these apertures or nozzles sizing agent or coating agent can be metered out and directly applied to the travelling web.

With regard to the position of the application means it is suitable that it is arranged in such a manner that. the application onto the travelling web takes place within the area where the web engages the support roll and particularly is positioned upstreams of the nip within a sector angle of up to about 30°. The lower limit is not particularly critical but it should be ensured that all coating agent reaches the web before the nip.

The application apparatus according to the present invention is suitably provided with a collection tray intended for gathering excess of sizing agent or coating agent originating from the nip and preferably also from said evening member. It is suitable in this connection to arrange the tube of the application means rotateable so that with interrupted coating of sizing agent or coating agent the tube can be turned to a position in which the material is discharged into said collection tray. This avoids the disadvantage residing in a need for interrupting the supply of material to the tube at minor shut downs. Such an interrupted supply of material to the application means can result in problems in the form of blocking of the metering slit or the apertures or other disadvantages.

In a particularly preferred embodiment of the application apparatus according to the present invention the predosage roll is on its mantle surface provided with circumferential, mutually parallel rifles or grooves. By this design a more accurate predosage of material deposited on the travelling web can be obtained. In connection with this embodiment the predosage roll is suitably provided on its mantle surface with a close wire winding, the individual wire turns pairwise forming said groove or rifle. As an alternative to such wire winding the roll can be provided with milled or cut grooves. With regard to details concerning these later embodiments reference is made to the Swedish lay-open print 463 078, the disclosure of which is introduced herein by reference.

An alternative preferred embodiment of the application apparatus according to the invention can be designed in such a manner that for the purpose of providing a contact surface which is substantially constant across the whole width of the web, the predosage roll is warped and forms an angle to the support roll. With regard to details concerning this embodiment reference is again made to the above Swedish lay-open print.

The member for final evening of the material supplied onto the travelling web can be designed in different ways and can for example be constituted by a kind of doctoring rib, and it is particularly preferred that said member comprises a conventional coating blade which is suitably arranged on a blade holder.

The present invention also provides a process for the application of sizing agent or coating agent on a travelling web, particularly a paper web, as for coating thereof. This process includes predosage and final evening of the coated material and is characterized in that the material is directly applied to said travelling web in excess and then predosed in connection with the passage of the web through a restriction zone for further transfer to a final evening zone.

From the above disclosure it is clear that the invention provides an application apparatus where the predosage roll contrary to the prior art is not used for the take up of sizing agent or coating agent by being immersed therein, and in addition to the fact that the disadvantages of the prior art as stated earlier are eliminated also other advantages are gained. Among these there may be mentioned that since the predosage roll is not immersed in the material to be applied the collecting tray can be made simpler and cheaper and, in addition, the risk for sedimentation in the tray is eliminated and the cleaning of the tray simplified.

The present invention will in the following be further described by non-limiting examples and with reference to the appended drawings, wherein:

FIG. 4 shows a corresponding side view, where FIG. 4A shows a detail view on a section of the mantle surface of the predosage roll;

FIG. 5 shows diagrammatically the position of the predosage roll in relation to the support roll to vary the contact surface between the support roll and the dosage roll;

FIGS. 6A–6C illustrate different contact surfaces between the rolls at varying inclination of the predosage rolls;

Figure 1:
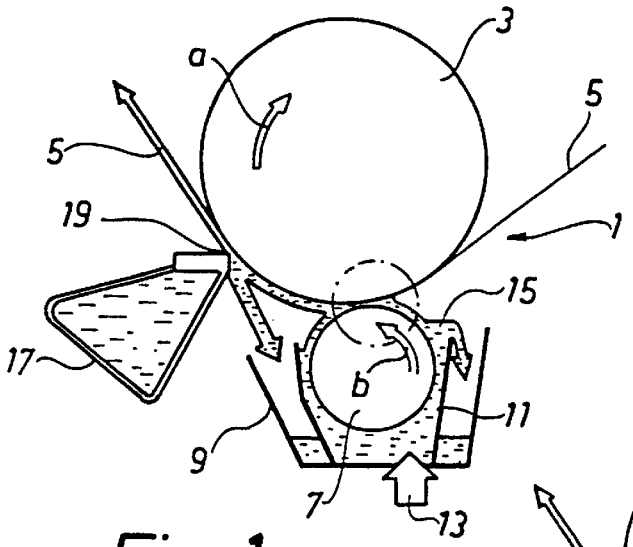
FIG. 1 shows diagrammatically in a side view an application apparatus designed in accordance with conventional art.

The application apparatus shown in FIG. 1 as seen in a diagrammatic side view is designed in accordance with conventional known techniques and comprises a support roll 3 rotated in the direction of arrow a and a support roll 7 rotated at a lower speed in the direction of arrow b. Between these two rolls 3,7 a paper web 5 is fed. The predosage roll 7 rotates in a collecting tray 9 with an interior tray 11, the latter tray containing coating paste 13 which via the predosage roll 7 is transferred to one side of paper web 5. The upper edge 15 of the interior tray acts as a overflow. In connection with the nip between the two rolls 3,7 a certain predosage of the coating paste 13 takes place, and the excess flows back to the collecting tray 9 via the ends of the dosage roll 7.

After this predosage with a large excess the paper web 5 travels further with coating paste applied thereto up to an evening member which can be constituted by a conventional coating blade 19 attached to a blade holder 17. Here final evening of the coating paste takes place, and the paper web 5 continues for continued treatment.

Figure 2:
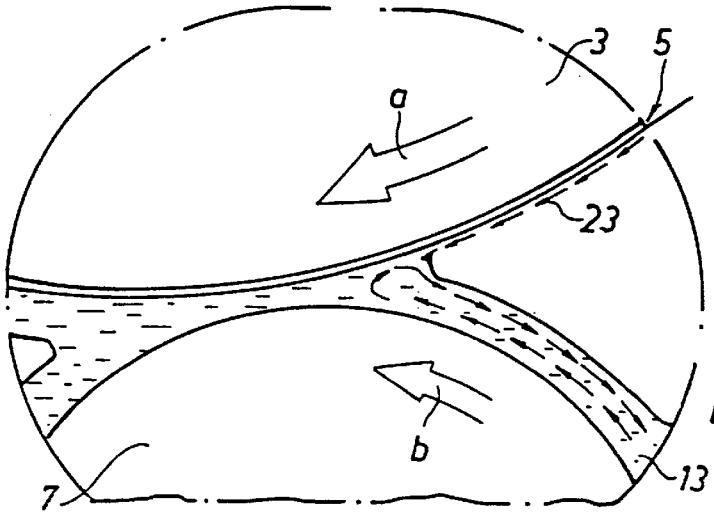
FIG. 2 shows a detail from FIG. 1 and in an enlargement the conditions in connection with the nip between the rolls.

FIG. 2 shows in enlargement the area around a nip between the rolls 3,7. The paper web 5 entrains in its travel an air film 23 which, when it meets the coating paste 13 supplied to the nip via the predosage roll 7, brings about a number of inconveniences. Among these inconveniences there may be mentioned local hindrance of the coating paste 13 from certain sections of the paper web 5, and admixture in the coating paste 13 causing inhomogeneities. The first-mentioned hindrance of coating paste results in the formation of uncoated sections, so called skips, which bring about undesirable quality variations in the treated paper. Admixture of air in the coating paste results in irregularities in the application phase and reduced quality of the paper produced.

Figure 3:
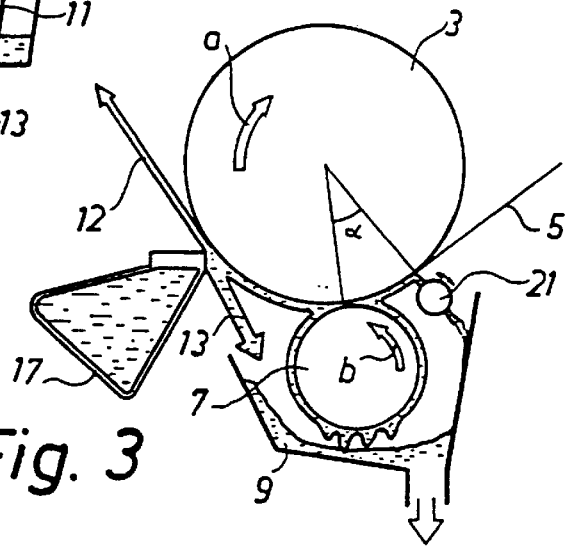
FIG. 3 shows diagrammatically in a side view an embodiment of the apparatus according to the present invention.

FIG. 3 shows an embodiment of the application apparatus according to the present invention, where the general design of the apparatus corresponds to that shown in FIG. 1. However, in the embodiment according to FIG. 3 the essential difference is that the predosage roll 7' is not immerseded in coating paste in the collecting tray 9, whereby the interior tray 11 shown in FIG. 1 can be dispensed with, which simplifies the design and results in lower cost. In the device according to FIG. 3 the coating paste 13 is applied via an applicator 21 which in principle consists of a tube extending along the travelling paper web 5 over the whole width thereof and which is provided with a longitudinally extending slit or openings or apertures placed in line along the tube, whereby coating paste 13 can be dispensed directly onto the paper web 5.

The position of applicator 21 is such that the coating paste 13 is fed upstreams of the nip between rolls 3,7' and within a sector angle $\alpha$ which is at most about 30°.

The function of the device shown in FIG. 3 is briefly as follows.

The support roll 3 is rotated in the direction of arrow a, whereby the paper web 5 is transported over a part of the peripheri of roll 3 in a direction from the right to the left as seen in FIG. 3. The predosage roll 7' is rotated in the direction of arrow b with a peripheral speed of roll 7' which is lower than the travelling speed of the web 5. Via applicator 21 coating paste 13 is supplied to the exterior surface of paper web 5, the metered quantity being in excess in relation to the final coating quantity. According to the present invention this excess can be kept as low as about 3 to 5 times the finally deposited quantity, which is in contrast to the prior art where for the provision of a complete coating an excess of 15 to 30 times the final applied quantity will be needed. At the entrance to the nip between rolls 3,7' predosage is provided, the excess flowing from the mantle surface of roll 7' and both ends thereof. The coated paper web then continues its movement up to the coating blade 19 where final evening and final dosage takes place. The excess in association with the coating blade 19 is returned to the collecting tray 9.

By the device shown in FIG. 3 and designed in accordance with the present invention the operational problems illustrated in connection with FIGS. 1 and 2 are avoided. Thus, the direct application of coating paste onto the paper web 5 means that no film of air can be entrained with the paper web into the nip between rolls 3,7' . Furthermore, admixture of air in the coating paste is substantially completely avoided. In this manner both the formation of skips is avoided and an even homogeneous coating will be obtained which means that a paper of high quality can be produced also at high web speeds up to about 2000 m/min. In the conventional prior art substantial problems from the point of view of quality arise already at web speeds substantially lower than about 1000 m/min.

In FIGS. 4 and 4A there is diagrammatically shown a device corresponding to that shown in FIG. 3 but in this embodiment the predosage roll 7' is provided on the mantle surface thereof with a close wire winding 25 ensuring a more even predosage of the coating paste. In the enlarged detail according to FIG. 4A there is shown part of the mantle surface of the predosage roll 7' with the close wire winding with the individual wires 25 and an exposed section 27 of the surface of roll 7'. With regard to details concerning rolls with ribbed or profiled surface for a more accurate predosage reference is made to the above-mentioned Swedish layopen print 463 078.

In FIG. 5 there is shown an arrangement in which the. predosage roll 7' is warped in relation to the supporting roll 3 for the purpose of providing contact surfaces between the two rolls of different designs. In FIG. 6A there is shown the design of the contact surface of a predosage roll which has not been compensated with regard to the contact pressure in the nip between the rolls 3,7'. As is clear from FIG. 6A the contact surface A1 has its minimal width in the middle of the rolls in view of the deflection of the predosage roll 7', whereas the width of the contact surface A1 is at a maximum at the ends. In FIG. 6B there is shown a contact surface A2 which is essentially constant along the whole length of rolls 3,7'. This can be obtained by warping of the predosage roll 7' in the manner shown in FIG. 5. An alternative way of providing an even contact surface along the whole length of the rolls is to make the predosage roll 7' cambered, i.e. the roll is designed with a larger diameter in the middle thereof than at the ends thereof.

In FIG. 6C there is finally shown a contact surface A3 which has a maximum at the mid point of the rolls. This state can be obtained either by cambering roll 7' too much or by warping same too far along the mantle surface of the support roll 3. With regard to details concerning the variation of the appearance of the contact surface reference is again made to the above-mentioned Swedish lay-open print.

Figure 7:
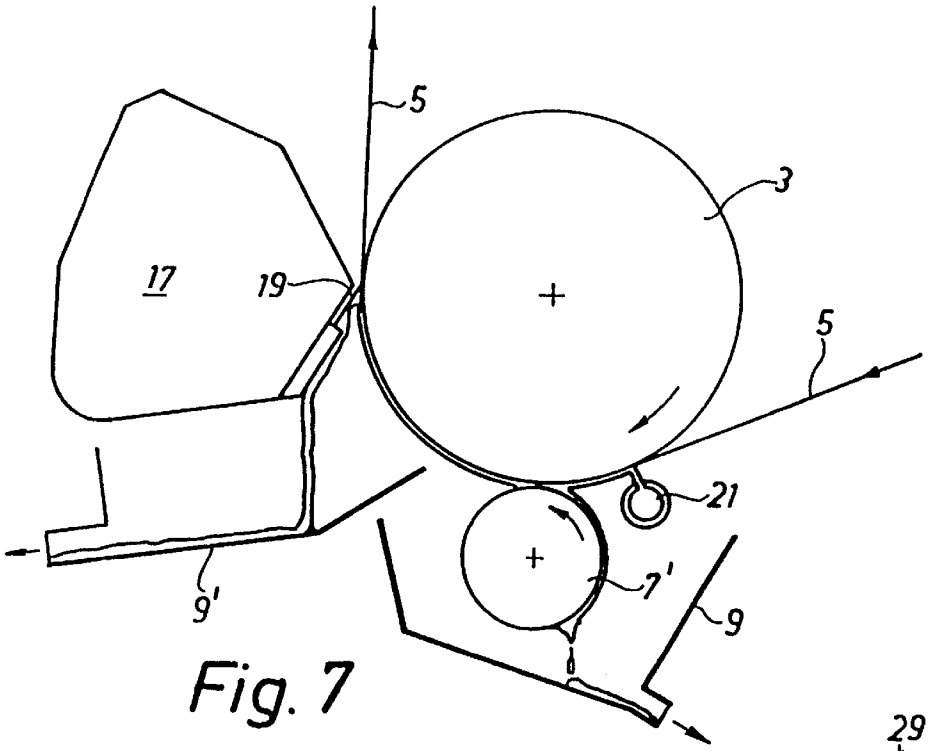
FIG. 7 shows diagrammatically a side view of an application apparatus according to the invention used in pilot plant tests.

In FIG. 7 there is diagrammatically shown a sideview of an application apparatus designed in accordance with the present invention. The application tube 21 in this apparatus is shown in detail in FIG. 8. Said application apparatus has been used in pilot plant experiments for the purpose of illustrating the advantages of the techniques according to the present invention.

EXAMPLE

In the experiments varying operational conditions were tested for the purpose of investigating the following.

1. Investigation as to whether the coating agent supplied up to the blade 19 could be reduced with maintained coating quality.
2. Investigation as to whether an uncoated paper side edge could be obtained by not applying coating paste up to the side edges of the paper web.
3. Investigation of the difference between spraying the coating paste directly on to the paper compared to spraying it directly into the nip between the rolls.

Figure 8:
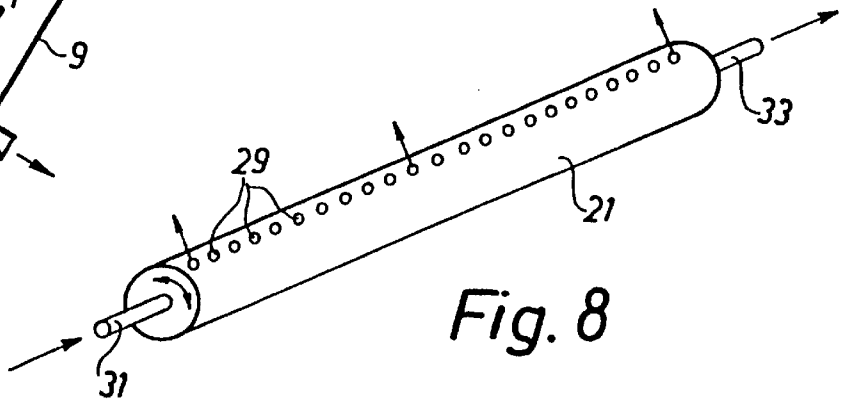
FIG. 8 shows a perspective view on the application tube used in the device according to FIG. 7.

A pilot plant coating apparatus designed in accordance with the illustrations of FIGS. 7 and 8 for web width of 50 cm intended for speeds up to 1200 m/min was used. The machine was provided with an application tube in accordance with FIG. 8 with metering holes for applying the coating paste directly onto the paper web 5. The hole distribution along the tube was 12 mm between the holes and the hole diameter was 2.5 mm. With a paper web width of 500 mm there was used an applicator tube 21 having 29 metering holes over a length of about 450 mm. In this manner no application was obtained over a distance of about 25 mm from each web edge.

In the experiment there was used a base paper which was free of wood and having a web weight of 120 g/m$^2$. The coating weight was 15 g/m$^2$ with a coating paste of 62% dry solids, a viscosity of 870.cP. The machine speed was varied and maintained at 200, 400, 600, 800 and 1000 m/min. The distance between the support roll 3 and the predosage roll 7' was 0.3 mm.

In the experiment the roll was marked for sampling for each speed step. The samples were investigated with regard to coated quantity, presence of skips and edge coverage. The recirculated quantity from the blade was measured at a speed of 800 m/min.

RESULTS

The quantity of coating paste applied was maintained constant at a level of 15 g/m$^2$ by pressure control of the coating blade, and this level was verified by test measurements. At all speeds the presence of skips on coated areas was totally avoided.

Outside of the coated section of the paper a completely covering layer of coating paste was found at a speed of 200 m/min. When increasing the speed the fully coated layer turned into partly coated surface and no coating was obtained at a speed of 800 m/min.

Figure 9:
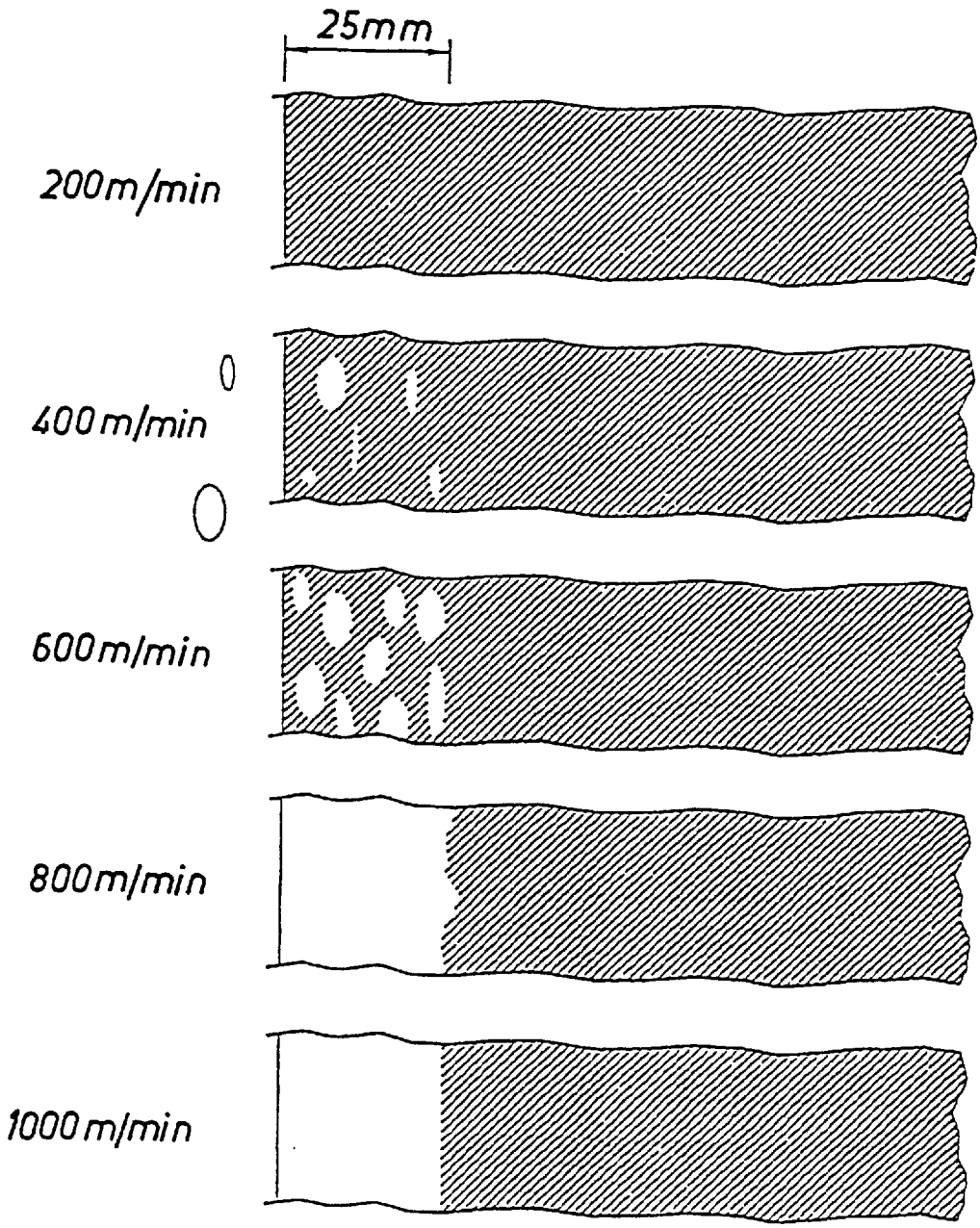
FIG. 9 shows coating results at varying web speeds.

The conditions at the side edges of the paper web is illustrated in FIG. 9, and it is clear therefrom that at a web speed of 200 m/min complete coverage of the paper web was obtained, whereas progressively lower degree of coating of the margin edges of the paper web was obtained at increasing speed so that at 800 m/min the paper margin was totally uncoated. In connection with the experiment an excess of coating paste was applied from the applicator tube at all speeds, whereby part of the excess is extruded sidewise and fills the nip also outside of the area applied. The fact that in spite of this at a higher speed does not result in coating of the paper web all the way out to the side edges constitutes evidence that the air film entrained with the paper forms a barrier preventing the coating paste from reaching the paper surface.

Another evidence for the presence of an air barrier resulting in skips was obtained in experiments carried out with the applicator tube 21 turned so that the coating paste was directed straight into the nip. Samples taken show that a skip-free surface is obtained when the jets were directed onto the paper web, whereas an extensive presence of skips could be noted when the jets were directed into the nip.

The measurement of the recirculated quantity of coating paste from the coating blade indicated a quantity of 42 kg/min at a speed of 500 m/min and converted to $g/m^2$ this equals 120 $g/m^2$. The estimated wet quantity after the coating blade was 24 $g/m^2$. Thus, these measurements give the result that the applied quantity was about 5 times larger than the finally applied layer. This can be compared with normally 15 to 30 times in accordance with conventional techniques.

It may be added that the applicator tube 21 shown in perspective in FIG. 8 is arranged rotatable around an inlet 31 and an outlet 33, whereby at short interruptions in operation the tube 21 can be rotated with the openings 29 facing downward, so that in this manner one does not have to interrupt the supply of coating agent, whereby blockage in the holes 29 is avoided. The coating agent flowing out during the shutdown can be collected in tray 9.

What is claimed is:

1. Application apparatus for coating a travelling web, comprising:

a support roll;

a predosage roll, the support roll and the predosage roll defining a nip through which a web travels, the support toll and the predosage roll both moving in a direction of movement of the web at the nip, the predosage roll being disposed beneath a bottom surface of the web;

an application device disposed at a distance from the predosage roll for transferring a coating material onto the bottom surface of the web upstream of the nip; and a doctoring device for evening of the material applied onto the web downstream of the nip, wherein the application device is arranged to transfer the material directly onto the travelling web in excess of a desired amount before the web enters the nip, the predosage roll being exposed at a lower part thereof to permit removal of excess material on the predosage roll by gravity, and the application device and the support roll define a space through which the web travels, the space being disposed upstream of the nip.

2. Application apparatus according to claim 1, wherein the application device includes a tube extending across substantially an entire width of the web, the tube including one or more openings through which the material is applied to the web.

3. Application apparatus according to claim 2, further comprising a collecting tray for collecting the material squeezed from the web at the nip and the doctoring device.

4. Application apparatus according to claim 3, wherein the tube is rotatable to permit discharge of the material into the collecting tray.

5. Application apparatus according to claim 4, wherein the surface of the predosage roll includes grooves.

6. Application apparatus according to claim 2, wherein the application device is disposed relative to the support roll upstream of the nip at a sector angle $\alpha$ of up to about 30°.

7. Application apparatus according to claim 6, further comprising a collecting tray for collecting material squeezed from the web at the nip and the doctoring device.

8. Application apparatus according to claim 2, wherein a surface of the predosage roll includes grooves.

9. Application apparatus according to claim 2, wherein the predosage roll is warped along its surface in an axial direction, and an axis of the predosage roll forms an angle with an axis of the support roll.

10. Application apparatus according to claim 2, wherein the doctoring device includes a coating blade.

11. Application apparatus according to claim 1, wherein the application device is disposed relative to the support roll upstream of the nip at a sector angle $\alpha$ of up to about 30° and the predosage roll is a self supporting roll.

12. Application apparatus according to claim 11, further comprising a collecting tray for collecting the material squeezed from the web at the nip and the doctoring device.

13. Application apparatus according to claim 11, wherein a surface of the predosage roll includes grooves.

14. Application apparatus according to claim 11, is warped along its surface in an axial direction, and an axis of the predosage roll forms an angle with an axis of the support roll.

15. Application apparatus according to claim 1, wherein a surface of the predosage roll includes grooves.

16. Application apparatus according to claim 1, wherein a wire winding is provided around a surface of the predosage roll and, with the surface, defines circumferential grooves.

17. Application apparatus according to claim 1, wherein a surface of the predosage roll includes grooves formed therein.

18. Application apparatus according to claim 1, wherein the predosage roll is warped along its surface in an axial direction, and an axis of the predosage roll forms an angle with an axis of the support roll.

19. Application apparatus according to claim 1, wherein the doctoring device includes a coating blade.

20. A process for the application of coating material onto a travelling web, comprising the steps of:

applying coating material with an application device to a bottom surface of a travelling web in excess of a desired amount of the material on the web;

performing a predosage step by passing the web to which the material has been applied through a restriction zone defined by a rotating drum and a self supporting predosage roller disposed at a distance from the application device, the rotating drum and the predosage roller moving in a direction of movement of the web at the restriction zone, to remove excess material from the bottom surface of the web and onto the predosage roller, the predosage roller being disposed beneath the bottom surface of the web;

removing excess material from the predosage roll by gravity; and performing a step of evening the material on the bottom surface of the web following the predosage step, wherein the application device and the rotating drum define a space through which the web travels, the space being disposed upstream of the restriction zone.

* * * * *